US008925478B2

(12) United States Patent
Graber

(10) Patent No.: US 8,925,478 B2
(45) Date of Patent: Jan. 6, 2015

(54) DIRECTIONAL ISOPHASIC TOROIDAL WHISTLE

(76) Inventor: Curtis E. Graber, Woodburn, IN (US)

( * ) Notice: Subject to any disclaimer, the term of this patent is extended or adjusted under 35 U.S.C. 154(b) by 305 days.

(21) Appl. No.: 13/460,932

(22) Filed: May 1, 2012

(65) Prior Publication Data

US 2013/0291784 A1 Nov. 7, 2013

(51) Int. Cl.
*G10K 5/00* (2006.01)
*G10K 11/26* (2006.01)
*G10K 11/28* (2006.01)

(52) U.S. Cl.
CPC *G10K 11/26* (2013.01); *G10K 5/00* (2013.01); *G10K 11/28* (2013.01)
USPC ..... 116/137 R

(58) Field of Classification Search
CPC ..... G10K 5/00; G10K 5/02; G10K 11/26; G10K 11/28
USPC ..... 116/137 R, 138, 139, 140, 142 FP, 116/142 FV, DIG. 19; 181/191, 192; 446/216
See application file for complete search history.

(56) References Cited

U.S. PATENT DOCUMENTS

| | | | | |
|---|---|---|---|---|
| 48,921 | A | 7/1865 | Fitts | |
| 596,257 | A | 12/1897 | Bartlett | |
| 1,449,211 | A | 3/1923 | Baker | |
| 1,515,471 | A * | 11/1924 | Foley | 116/137 R |
| 1,786,122 | A * | 12/1930 | McElvaney, Jr. et al. | 116/137 R |
| 1,796,887 | A * | 3/1931 | Critchfield | 116/139 |
| 2,092,405 | A | 9/1937 | Neveu | |
| 2,238,668 | A * | 4/1941 | Wellenstein | 116/137 A |
| 2,678,625 | A * | 5/1954 | Hall et al. | 116/137 R |
| 2,755,767 | A * | 7/1956 | Levavasseur | 116/137 A |
| 3,169,508 | A * | 2/1965 | Rich | 116/137 A |
| 3,772,687 | A * | 11/1973 | Scott | 340/404.3 |
| 4,408,719 | A * | 10/1983 | Last | 239/417 |
| 4,429,656 | A | 2/1984 | Weisenberger | |
| 4,686,928 | A | 8/1987 | Weisenberger | |
| 5,163,167 | A * | 11/1992 | Heil | 181/152 |
| 5,864,517 | A * | 1/1999 | Hinkey et al. | 367/145 |
| 7,793,607 | B1 | 9/2010 | Geist | |
| 7,908,991 | B2 * | 3/2011 | Woods et al. | 116/142 FP |
| 2007/0080019 | A1 * | 4/2007 | Kubota | 181/185 |

FOREIGN PATENT DOCUMENTS

| | | |
|---|---|---|
| DE | 84935 | 1/1896 |
| DE | 523008 | 4/1931 |
| DE | 2537540 A * | 2/1977 |

* cited by examiner

*Primary Examiner* — Richard A Smith
(74) *Attorney, Agent, or Firm* — Taylor IP, P.C.

(57) ABSTRACT

An acoustic projector includes a toroidal whistle having an annular mouth and a foot set in a bowl like reflector. The reflector extends radially outwardly from the foot and has a concave section circumscribing the annular mouth. A whistle bowl is configured to suppress turbulence in air flow and thereby provide laminar flow to an outlet jet orifice into the annular mouth. The concave section is shaped to reflect isophasic sound generated at the mouth in a coherent beam.

12 Claims, 10 Drawing Sheets

DIRECTIONAL ISOPHASIC TOROIDAL WHISTLE

BACKGROUND

1. Technical Field

The field relates to sound generation and projection and more particularly to a toroidal whistle assembly for generation and projection of a high intensity sound beam.

2. Description of the Technical Field

Toroidal whistles have a cylindrical blade aligned on an annular gas outlet/orifice of the same diameter. A jet of air from the outlet impinges on the blade, which is spaced from the orifice to define the whistle mouth. The flow of the jet alternates from side to side of the blade in response to pressure changes in a resonance chamber located to the inside of the blade. The diameter of the torus shaped resonance chamber adjacent the blade can be increased without altering the cross sectional area of the resonance chamber by adjusting the size of an interior cylinder. This allows construction of whistles of very large diameters without change of the whistle resonant frequency. Toroidal whistles thus can be expanded to operate at extreme volume levels while retaining virtually any desired design frequency. Locomotive whistles are a well known example of an application of toroidal whistles. A modern toroidal whistle is taught in U.S. Pat. No. 4,429,656 to Weisenberger.

Weisenberger adapted his whistle design to construct a directional toroidal whistle as taught in U.S. Pat. No. 4,686,928. There a toroidal whistle was inverted (the annular mouth of the whistle was placed to face inwardly) and the annular mouth was located near the base of a horn. A phase plug was centered at the horn base surrounded by the annular whistle mouth.

SUMMARY

An acoustic projector includes a toroidal whistle having an annular mouth and a foot set in a bowl like reflector. The reflector extends radially outwardly from the foot and has a concave section circumscribing the annular mouth. A whistle bowl is configured to suppress turbulence in air flow and thereby provide laminar flow to an outlet jet orifice into the annular mouth. The concave section is shaped to reflect isophasic sound generated at the mouth in a coherent beam.

BRIEF DESCRIPTION OF THE DRAWINGS

Understanding of the following description may be enhanced by reference to the accompanying drawings wherein.

DETAILED DESCRIPTION

Figure 1:
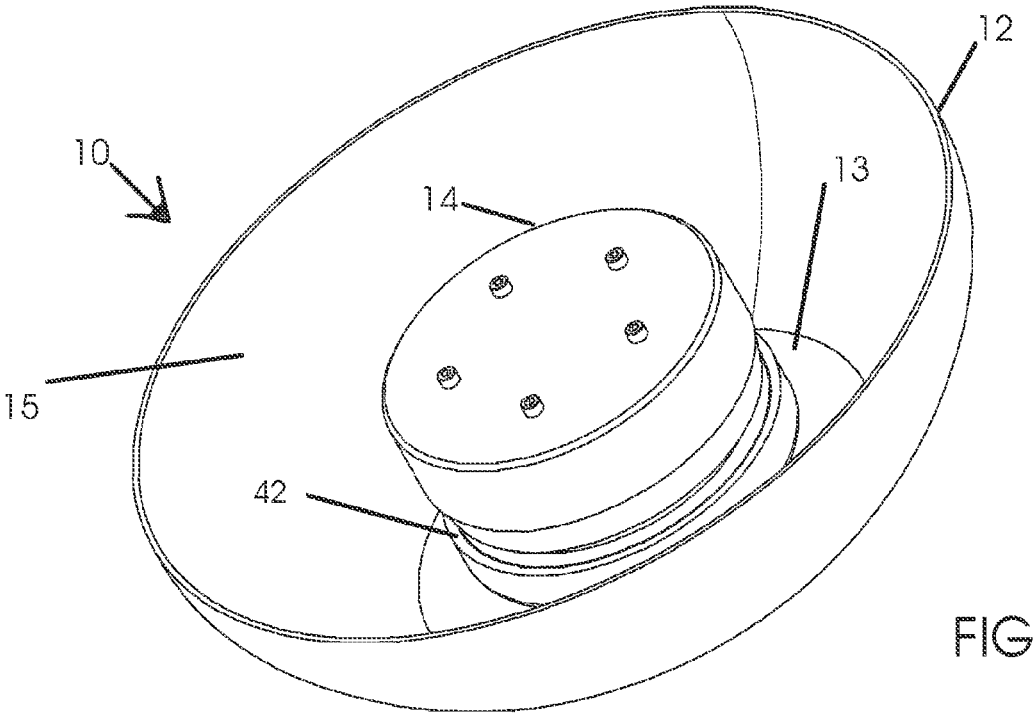
FIG. 1 is a perspective view of a toroidal whistle and focusing dish.

Referring to the figures and in particular to FIG. 1, an isophasic whistle assembly 10 providing directionality of sound is shown. Whistle assembly 10 comprises a reflector 12 which collects sound emitted in isophasic toroidal pressure fronts from the annular mouth 42 of a toroidal whistle 14. Reflector 12 has a generally bowl like shape with an inner, flattened, central base 13 and a concave outer section 15. The outer section 15 may have a uniform hyperbolic cross sectional profile having an inner focus (see FIG. 4). The focus of outer section 15 taken collectively can be made annular and to fall short of the center line or intended projected axis of the device. The annular mouth 42 should be located on this "focal ring." The outer section 15, when shaped for focusing, directs sound forward/outwardly from the reflector 12 in a beam centered on radiant axis RA (see FIG. 2) with minimum divergence away from the axis. A profile can be chosen for outer section 15 to provide for beam convergence for focusing the beam on a point forward from the reflector 12.

Concave section 15 captures isophasic acoustic energy emitted from annular mouth 42. The concave section 15 is shaped to capture and reflect the sound in a coherent beam. The reflected/radiated coherent beam has less than 5 degrees of divergence at its tuned frequency spectrum and can produce beam angles of as low as 1 degree assuming a reflector scale of 4 times the target wavelength for the sound.

Figure 2:
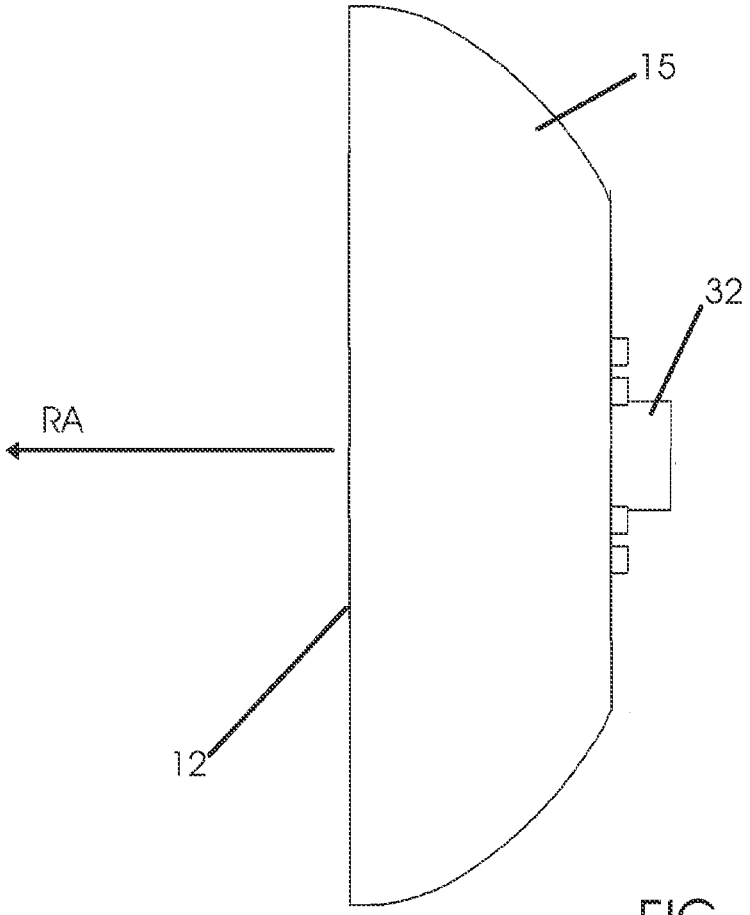
FIG. 2 is a side elevation of the focusing dish of FIG. 1.
Figure 3:
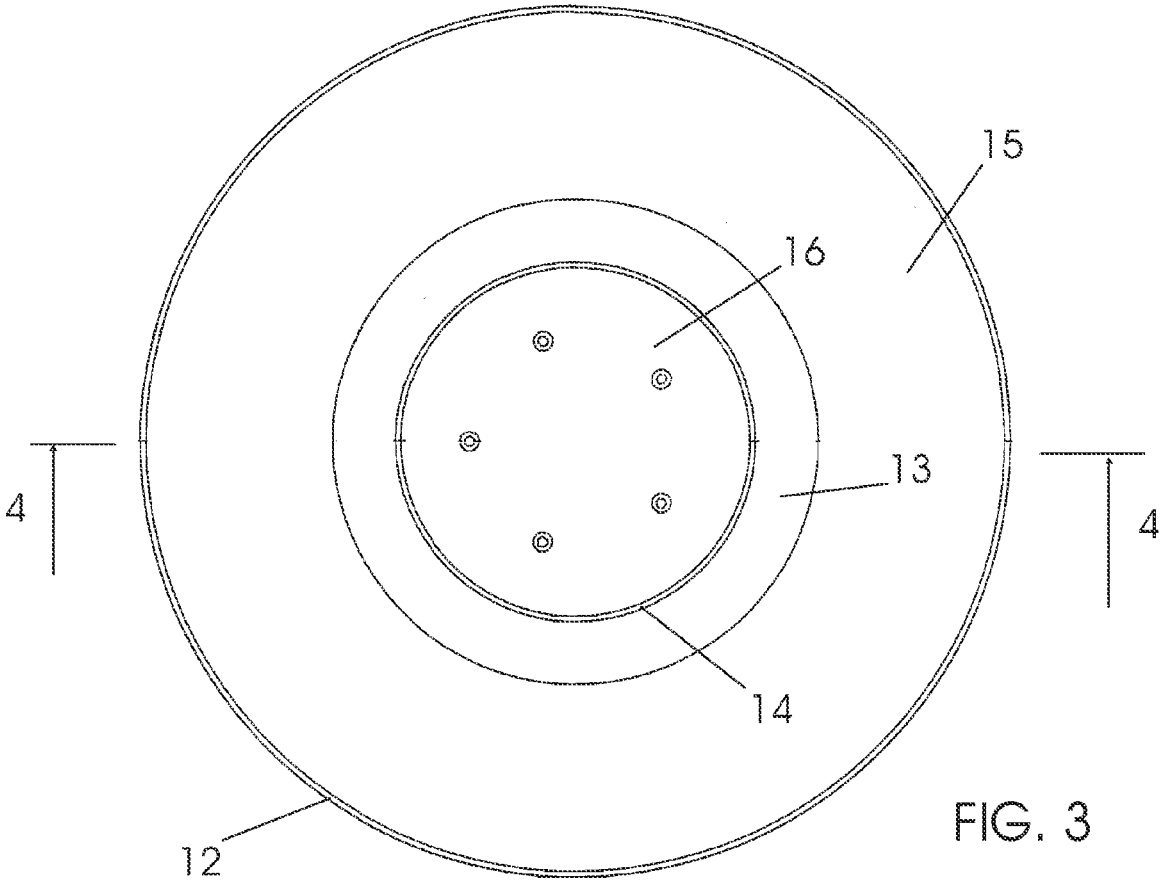
FIG. 3 is a top plan view of the toroidal whistle and focusing dish.

FIGS. 2 and 3 illustrate the relatively interior position of the central base 13 to the outer section 15 of reflector 12. A whistle foot 32 is located centered on the central base 13 of the reflector 12.

Figure 4:
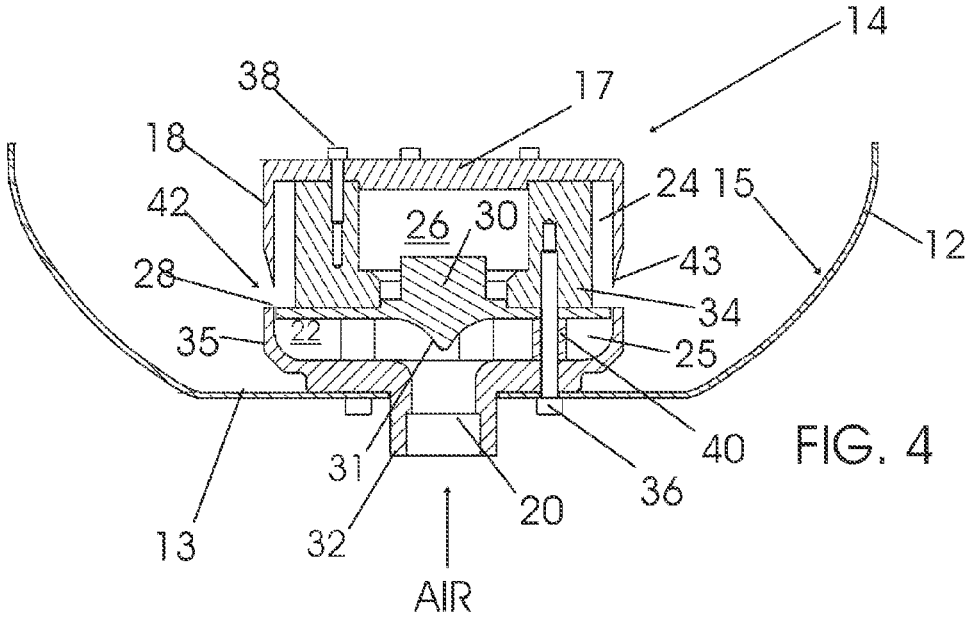
FIG. 4 is a cross-sectional view of the toroidal whistle and focusing dish taken along section lines 4-4 of FIG. 3.
Figure 5:
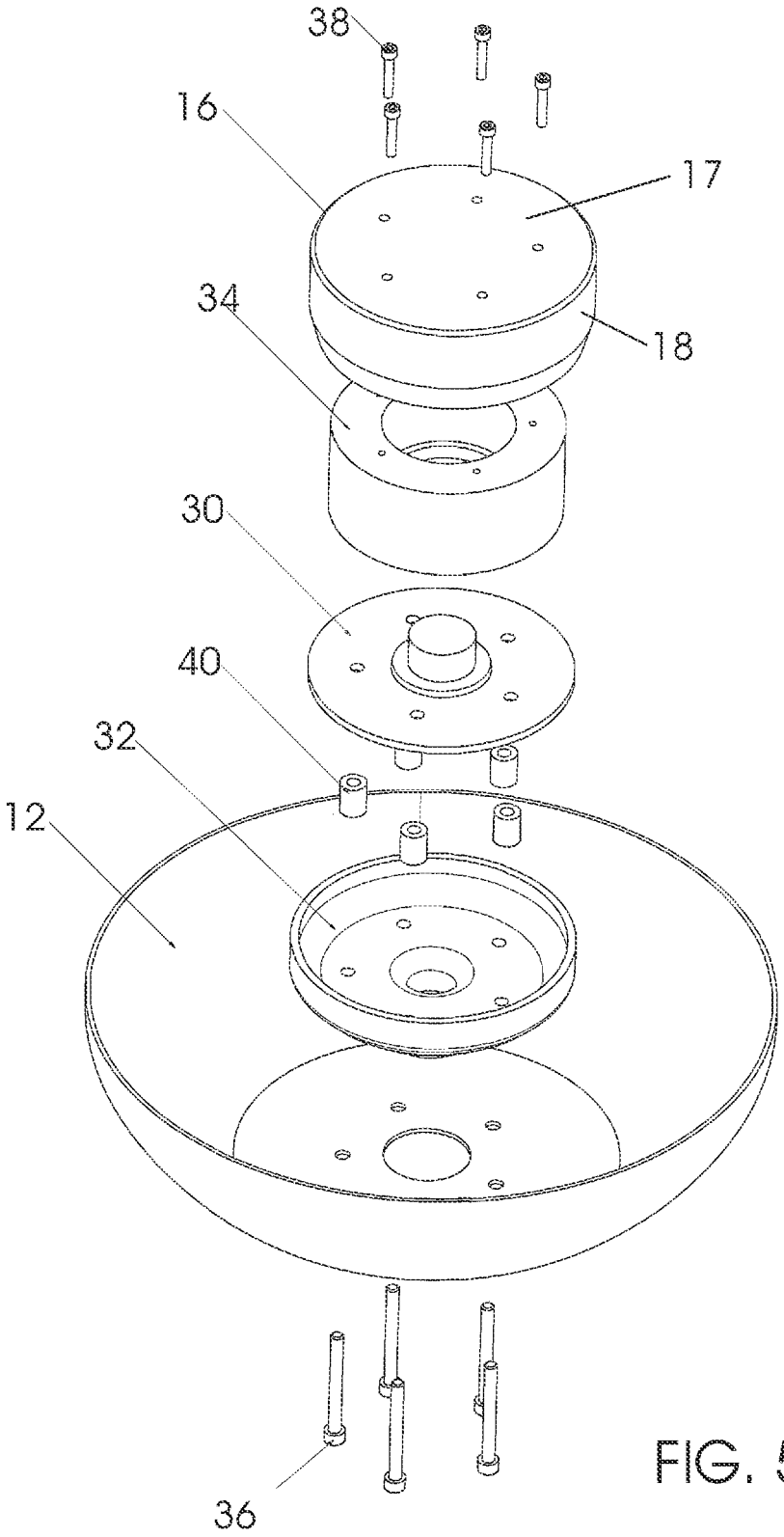
FIG. 5 is an exploded perspective view of the toroidal whistle and focusing dish.

Referring now to the cross sectional view of the sound focusing whistle assembly 10 in FIG. 4, the positioning of toroidal whistle 14 in reflector 12 is better seen and the hyperbolic profile of the outer section 15 illustrated. The components used in construction of the device are shown in FIGS. 4 and 5. The toroidal whistle 14 has a whistle foot 32 which is shaped generally as a flattened bowl 25. Whistle foot 32 has a stem section 33 extending from its bottom face. A cylindrical side wall 35 forms the side of the bowl 25. The stem section 33 includes a central aperture 20 providing a passageway through the foot 32 into a bowl 25. Central aperture 20 is accessible through a hole in the center of the flattened base section 13 of reflector 12 to allow air to be supplied to toroidal whistle 14 under pressure.

The bowl 25 of foot 32 is largely covered by a languid plate 30. Languid plate 30 is generally disk shaped and fits inside the cylindrical wall 35 of foot 32. The languid plate 30 is sized to leave a narrow annular slit 28 around its perimeter edge between the languid plate and the inside face of the cylindrical wall 35. The languid plate 30 is supported at the top of the bowl 25 of base section 32 on spacers 40 so that bowl 25 serves to funnel air from the central aperture 20 to the annular slit 28. Annular slit 28 provides an outlet orifice for air from the bowl 25.

Air delivered under pressure to the bowl 25 through central aperture 20 escapes the bowl as a cylindrical jet from the annular slit 28. Bowl 25 calms turbulence in the flow of air from the central aperture 20 to the annular slit 28. In particular, the stream of air entering the bowl 25 from the central aperture 20 is centered on and is radially split by a central cone 31 projecting from the bottom face of the languid plate 30. The air is distributed off central cone 31 into a toroidal calming area 22 between the central cone and the annular slit 28. The toroidal claming area 22 also buffers air before its release to stabilize pressure in the annular slit 28. With a non-turbulent air mass cross section or laminar flow of air presented to the annular slit 28, a single mode, cylindrical jet of high volume, low pressure air is ejected. This jet of air then acts upon the tuned resonance chamber 24 for highly efficient and isophasic generation of sound.

The laminar flow air path provided by bowl 25 to and through the annular slit 28 increases the airflow volumetric efficiency as compared to prior art devices which typically had to operate at a higher psi resulting in an overblown condition. Overblowing does not result in generation of the primary tone of a pipe or whistle, but generates higher harmonic frequencies. Overblowing is the acoustic output limitation of any whistle design. A laminar flow bowl 25 allows the present toroidal whistle 14 to generate 6-10 db of additional output prior to on-set of an overblow condition. A typical flow rate is 60 $ft^3$/min. Pressure can be as low as 30 psi but can be increased up to 1100 psi before overblow conditions arise.

A torus 34 is supported on the major surface of languid plate 30 opposite its face covering bowl 25. The outer perimeter of torus 34 is inside the annular slit 28. The torus 34 in turn supports a bell 16 having a stop 17 and a circular blade 18. An interior cavity 26 is defined between the top of languid plate 30, the interior surface of torus 34 and the bottom of stop 17.

A downward oriented cylindrical blade 18 depends from the outer edge of the stop 17. Cylindrical blade 18 tapers to a fine edge which forms an upper lip 43 to the annular mouth 42. Upper lip 43 is aligned on the annular slit 28 though spaced therefrom. In operation the air flow or jet emitted from annular slit 28 hits the upper lip 43 with flow alternating between sides of the blade 18 at a regular frequency. As a result air in the tuned resonance chamber 24 should be subjected to relatively uniform alternating compression and release around its circumference. The air jet functions as a vibratory virtual piston through the full circumference of the device producing the acoustic energy at a frequency defined by the resonance of the tuned resonance chamber 24 (hence the regular isophasic sound waves emitted from annular mouth 42) with the possibility of pulse modulations through operation of the solenoid 52 controlled valve 50 (See FIG. 6).

The spacing between the cylindrical blade 18 and torus 34 defines the width of a tuned resonance chamber 24. The height of the tuned resonance chamber 24 within bell 16 is defined by the height or length selected for torus 34 and extends from the languid plate 30 to the stop 17.

Structurally whistle assembly 10 and toroidal whistle 14 are held together using two sets of five pins each. Inserted from the central base 13 through the foot 32, spacers 40, interior plate 30 and into torus 34 are base assembly pins 36. Inserted through the bell 16 into the torus 34 are five bell attachment pins 38. Here, where pin sets comprise five pins each, the pins are arranged pentagonally.

The bottom edge of cylindrical blade 18 forms the upper lip 43 of the annular mouth 42. Whistle annular mouth 42 extends for the full circumference of the toroidal whistle 14. Toroidal whistles may be built with less than a full annular mouth. For example, a series of arc mouths could be used. The annular mouth 42 has an area defined by its height (the distance from annular slit 28/languid plate 30 to the upper lip 43 times the circumference of the whistle 14. The location of the annular mouth 42 should correspond to a focal ring of the hyperbolically shaped outer section 15 of reflector 12. Reflectors having focal rings as opposed to a single focal point have been described in connection for use with loudspeakers in other contexts, for example U.S. Pat. No. 7,766,122 to Graber, which is incorporated herein by reference or United U.S. Pat. No. 4,836,328 to Feralli. The Graber '122 teaches use of a spike reflector in connection with a circular array of loudspeakers operating in unison. For a fixed circumference whistle 14 increasing the height of the mouth 42 increases the area of the mouth and thereby increases the possible maximum volume which can be achieved from the whistle 14.

With a conventional piston/diaphragm loudspeaker, the mass of the moving diaphragm and piston inversely affect the sensitivity and efficiency of the system. In a whistle a continuous jet of air flows to alternating sides of a blade to provide an extremely low mass replacement for the piston/diaphragm operating on a resonance chamber. In addition, in a conventional loudspeaker the peak amplitude of the device is piston square area over peak to peak deflection. In a radial whistle with a nearly massless jet of air the possibility of peak to peak deflection approaching 90 degrees total exists (+/−45 degrees from 0 degrees) while retaining isophasic operation around the circumference of the mouth 42.

Figure 6:
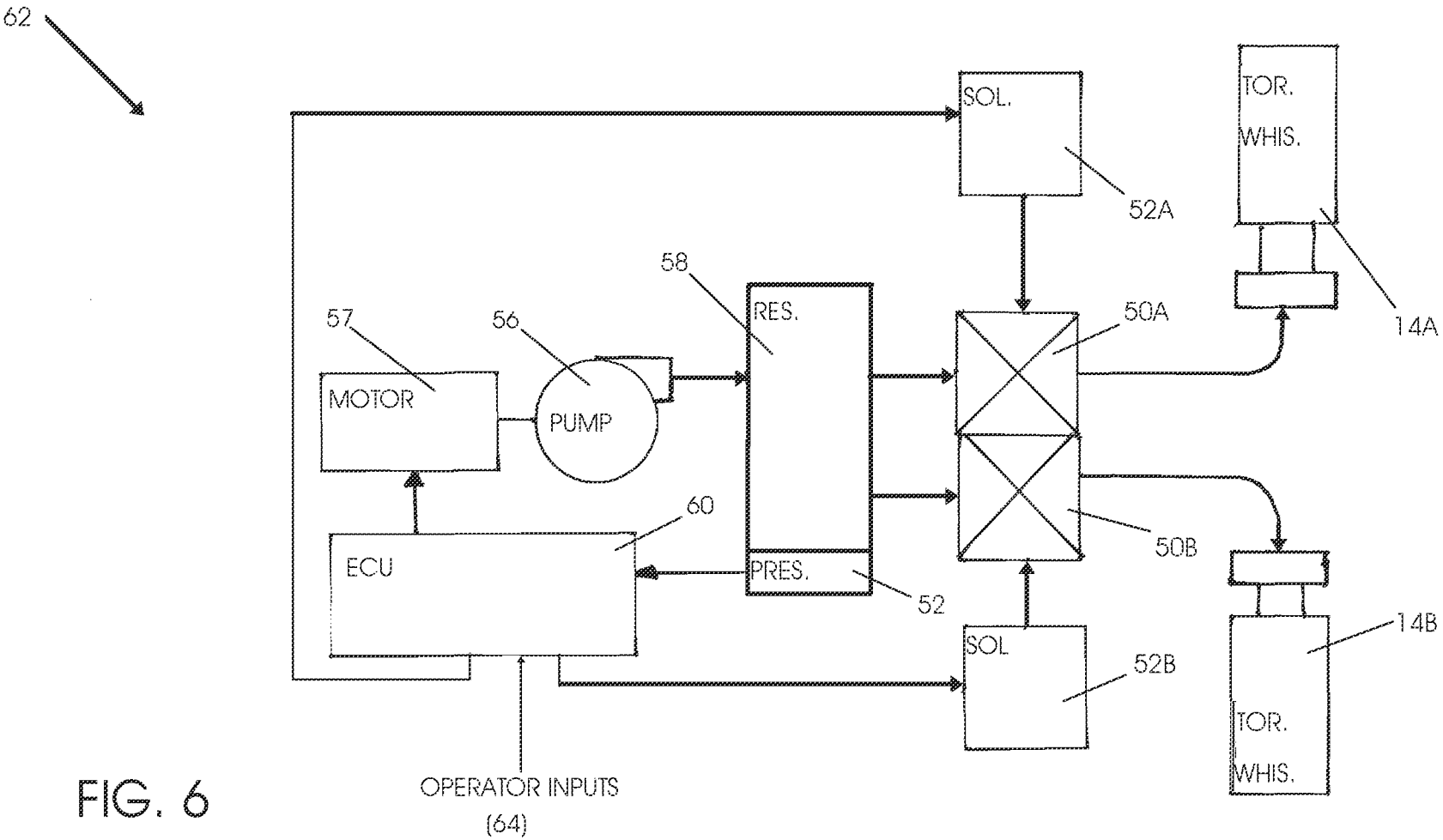
FIG. 6 is a schematic of the air delivery system for the toroidal whistle.

FIG. 6 is a schematic illustration of a possible air supply system 62 which provides controlled delivery of air at selected pressures to one or more toroidal whistles 14A, 14B. A simplified system used with a single whistle 14 would delete the "B" components. Ambient air is pressurized using a motor 57 powered pump 56 which supplies a reservoir 58 with air. A pressure sensor 59 provides pressure readings to a electronic control unit 54 which controls operation of the motor 57 to maintain pressure in reservoir 58 above a minimum. Air under pressure is supplied to whistle 14 from reservoir 58 through valves 50A, 50B or 50A and B. Opening and closing of valves 50A, B is effected by solenoids 52A, 52B which are also under the control of electronic control unit 54. Operator inputs 64 allow an operator to operate whistle 14A, 14B. A simpler system could make use of a compressed air tank and a pressure regulator to supply whistles 14A, B with mechanical trigger connected to the valves to supply the pressure regulator. Use of electronic control unit 60 and solenoids 52A, B allow more nuanced control the positioning of valves 50A, B to modulate the pressure of air supplied to the whistle 14A, B. Variation in air pressure is a method of controlling the frequency of sound produced by the whistle 14A, B. The electronic control unit 54 for the solenoids 52A, B can be used to provide pulse width modulation time sequences to generate different low frequencies or duty cycles of the device. It will be recognized by those skilled in the art that the number of whistles make in increased limited only by the ability of the air supply to deliver air. Such systems may be pitched as a chord and use of electronic control unit 60 allows the use of differential phase delay to set up beats between whistle tones as systems move in and out of phase.

Figure 14:
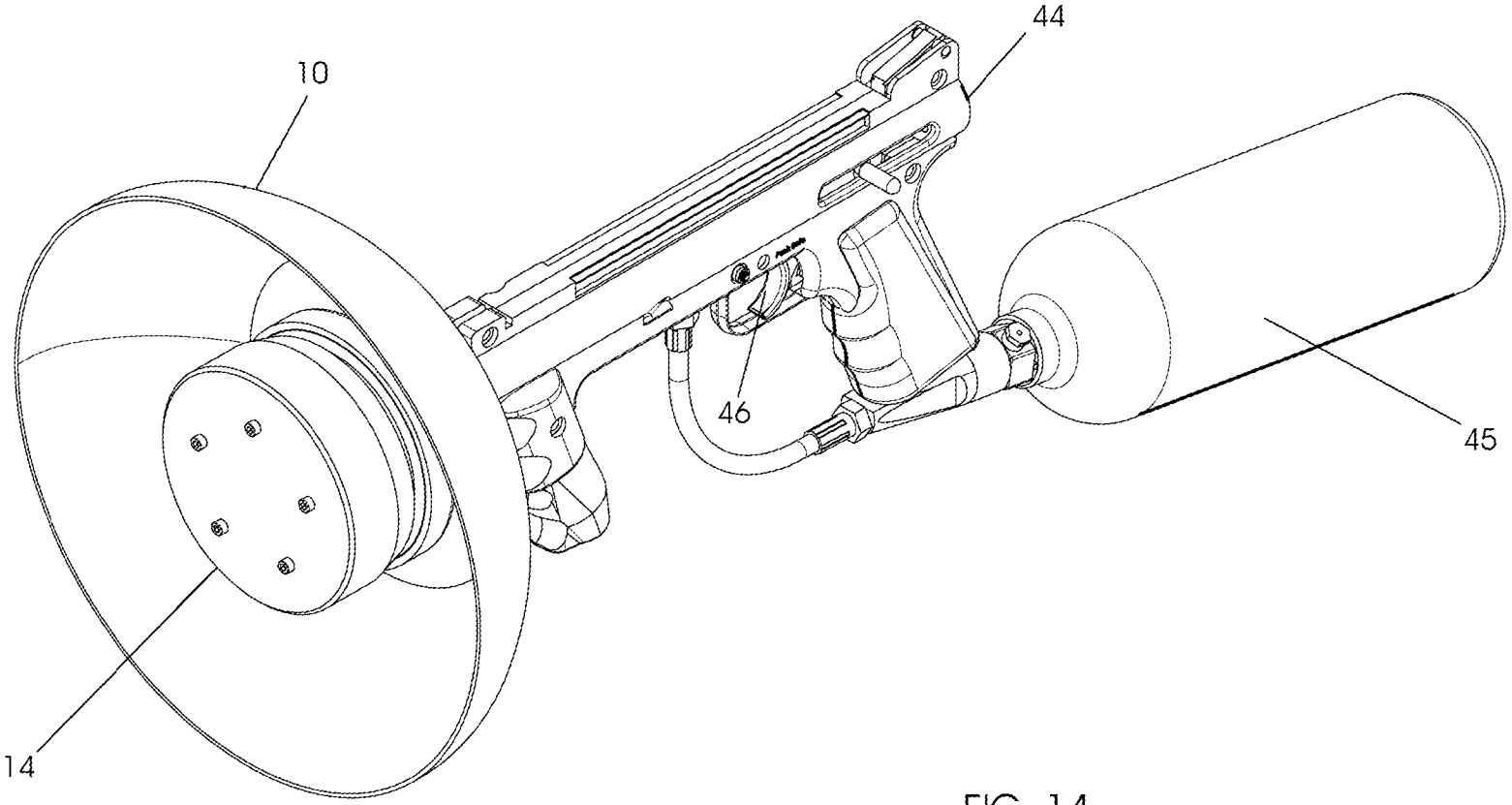
FIG. 14 is a perspective view of the whistle assembly of FIG. 1 mounted on a paintball marker.

Air supply systems which may be modified for use with the presently disclosed toroidal whistle embodiments include those used with paintball markers such as those built and marketed by Tippmann Sports LLC of Fort Wayne, Ind. and Buffalo Grove, Ill. Generally modifications used with these devices relate to promoting air flow through the devices. An example of a whistle assembly 10 mounted to a paintball marker 44 is shown in FIG. 14. A compressed air tank 45 is provided and serves some of the same functions of reservoir 58, but no pump 56 is used. A trigger 46 provides a simplified source for control inputs 60.

Figure 7:
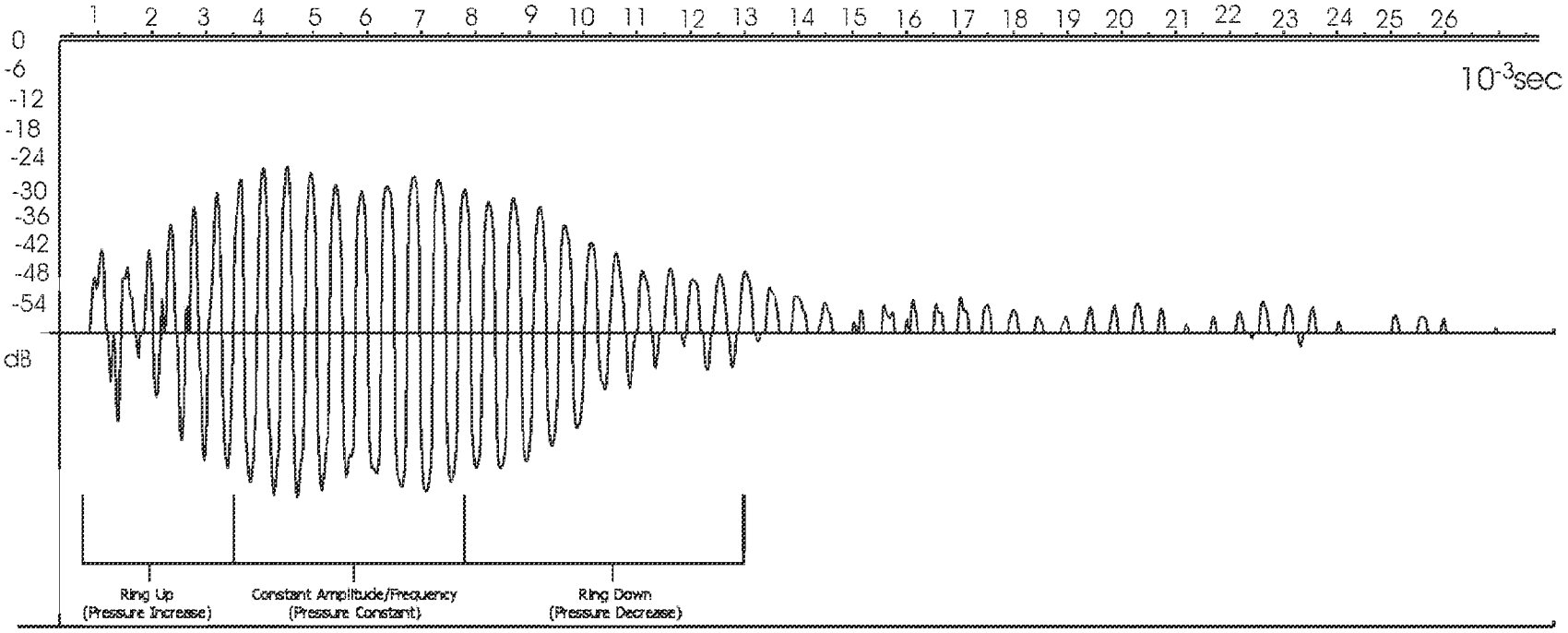
FIG. 7 is a graph illustrating a waveform for a single chirp from a toroidal whistle.
Figure 8:
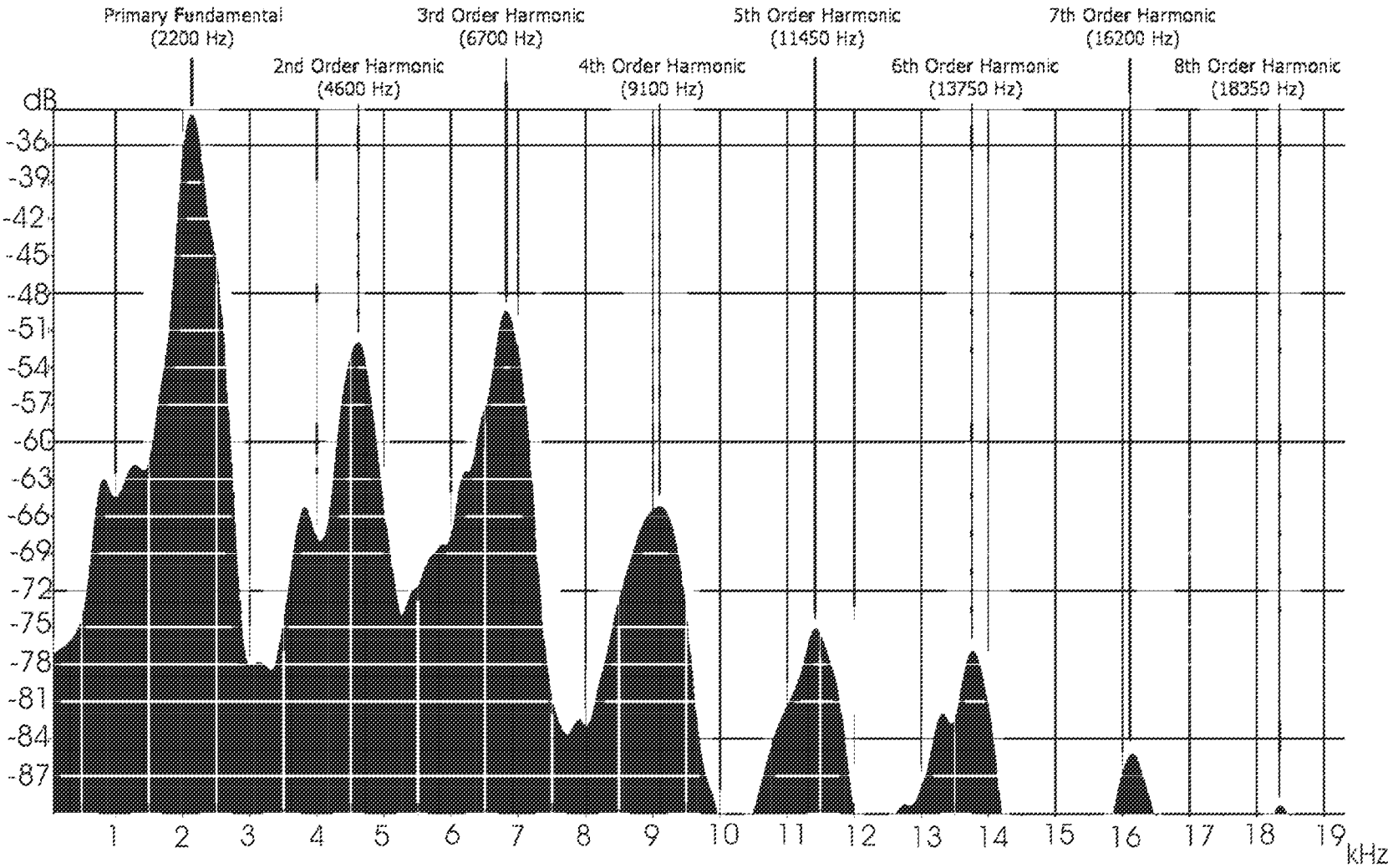
FIG. 8 graphically illustrates the frequency spectrum for the chirp of FIG. 7.
Figure 9:
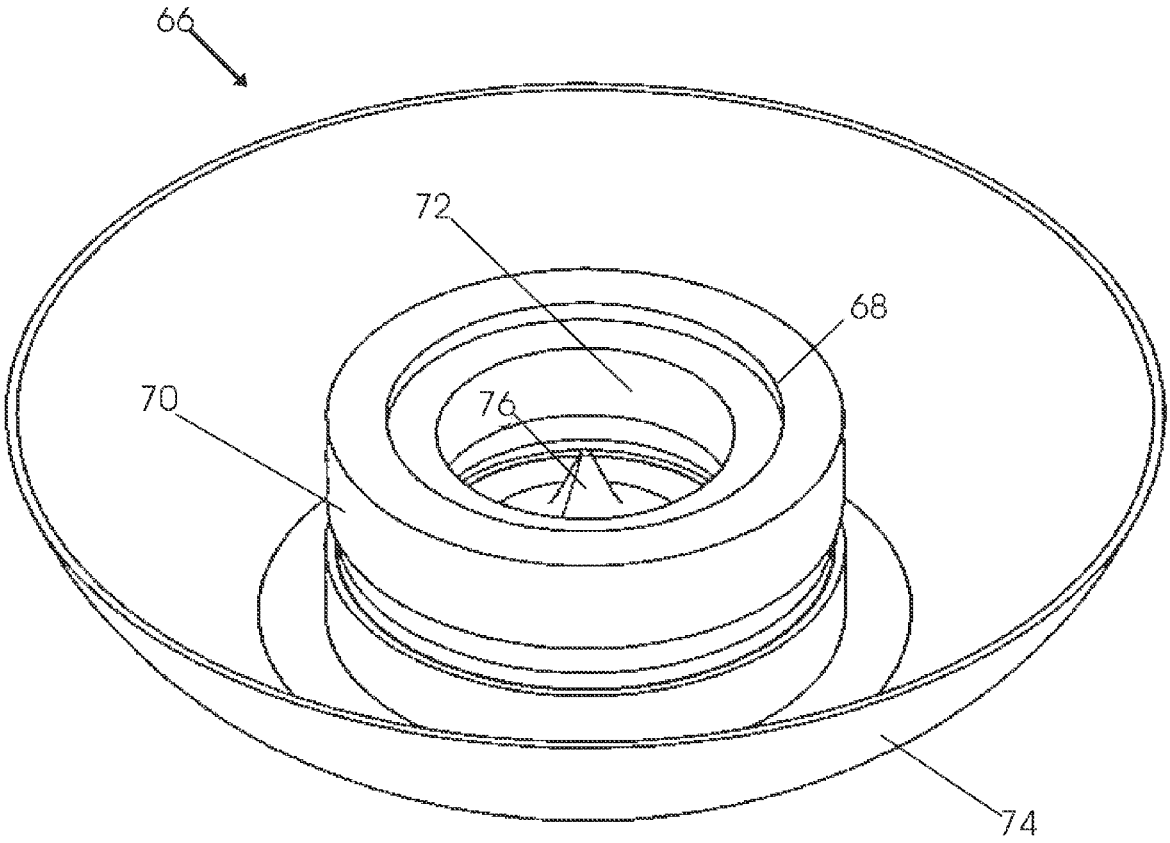
FIG. 9 is a perspective view of toroidal whistle assembly adding an inverted toroidal whistle.
Figure 10:
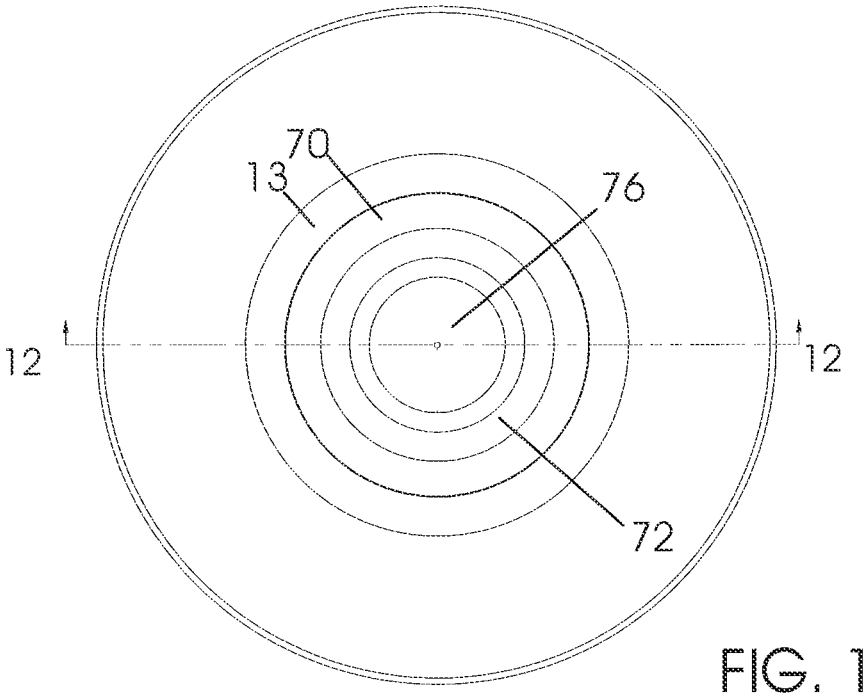
FIG. 10 is a top plan view of the assembly of FIG. 9.
Figure 11:
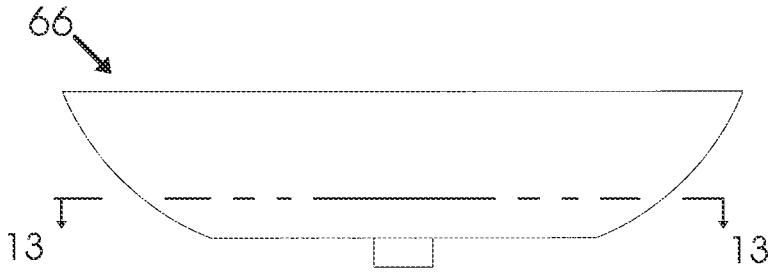
FIG. 11 is a side elevation of the assembly of FIG. 9.

Use of a high speed solenoid 52 allows for complex waveform generation as opposed to just simple on-off operation. For example, modulation of the flow of air to bowl 25 can be done to create a narrow bandwidth sweep in the resonant frequency due to the air pressure ramp up in each action of opening valve 50. On/Off modulation of the solenoid 52 valve 50 can be used to produce a secondary low frequency function at between 1-25 Hz in bursts from the device. For a toroidal whistle having a resonant frequency of 2.2 kHz these bursts can last just a fraction of a second having a ramp or ring up of about 5 cycles, a constant pressure plateau of about 7-9 cycles and a ring down of 10 to 12 cycles as shown in FIG. 7. The device is a positive displacement device which can clearly be seen in the ring down range where positive displacement of the compression wave exceeds negative displacement of the rarefaction portion of the sound wave. The effect on someone hearing the device in operation is that of chirping. The wave is not a pure sine wave and includes higher harmonics as illustrated in FIG. 8. Tailoring the frequency spectrum to match local birds of prey may be effective where the device is applied to bird control.

Referring to FIGS. 9-13 a second whistle assembly 66 embodiment is illustrated. The radiating surface for whistle assembly 66 can be either a reflector having a concave section or a spike. Whistle assembly 66 is based around a double whistle 68 comprising an outer toroidal whistle 70 and an inner inverted toroidal whistle 72. Sound generated by outer toroidal whistle 70 is reflected forward by a reflector 74 which functions in the same manner as reflector 12. Inner inverted whistle 72 directs sound against a spike reflector 76 which is centered on the forward radiant axis of the assembly 66. Spike reflector 76 is shaped to define a focus ring.

Figure 12:
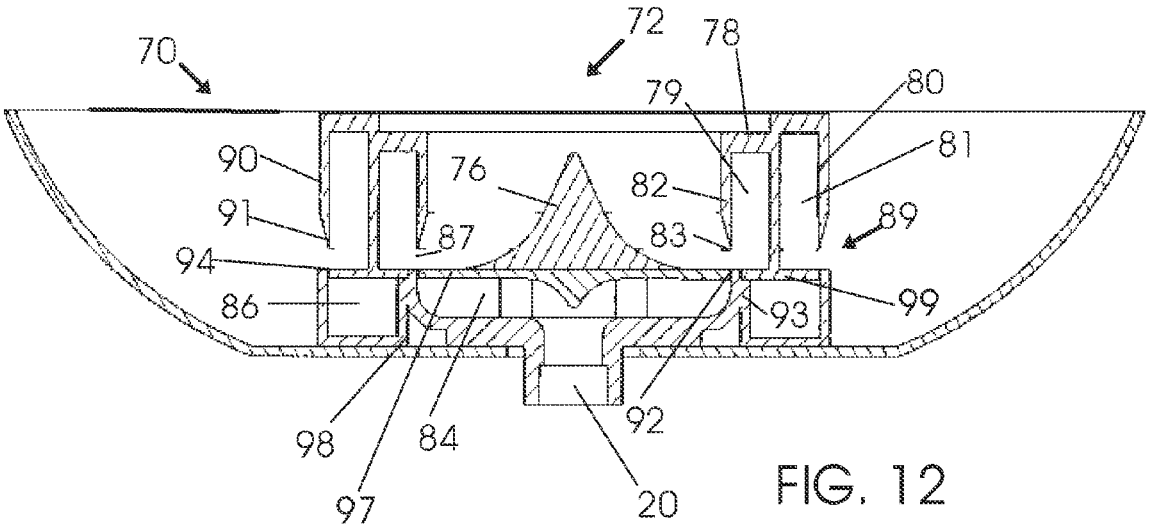
FIG. 12 is a sectional view taken along section line 12-12 of FIG. 10.
Figure 13:
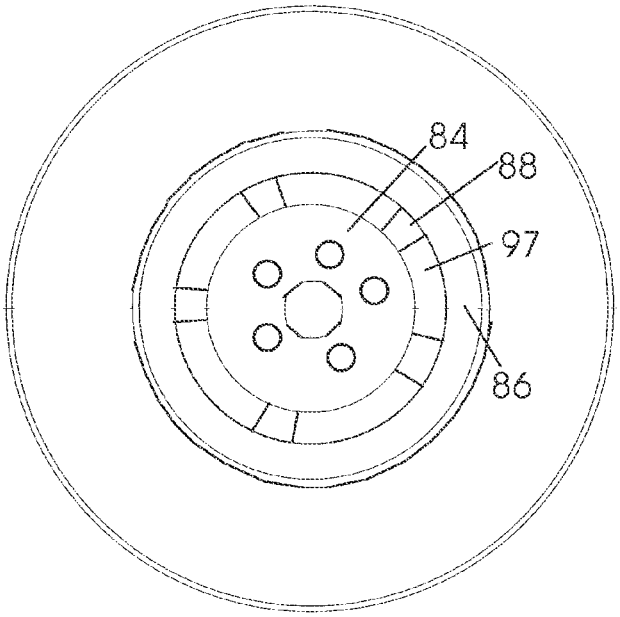
FIG. 13 is a sectional view taken along section line 13-13 of FIG. 11.

Referring particularly to FIGS. 12 and 13 it may be seen that outer toroidal whistle 70 encircles inner inverted toroidal whistle 72 and is adjacent thereto. Inner inverted toroidal whistle 72 has an annular mouth 87 from a resonance chamber 79. The annular mouth 87 is defined between upper lip 83 and an inner languid plate 97. Upper lip 87 is formed by the bottom edge of a cylindrical blade 82 and is positioned directly above and pointed at an annular slit 92 which is left between the perimeter of the inner languid plate 97 and wall 93.

Outer toroidal whistle 70 has an outwardly directed annular mouth 89 defined between upper lip 91 at the bottom of cylindrical blade 90 and the outer languid plate 99. Outer languid plate 99 supports inner and outer bells 78, 80. A resonance chamber 81 for outer toroidal whistle 70 is located within outer bell 80. Blade 90 is aligned on an annular slit 94 from which a cylindrical jet of air flows when the whistle is active.

Inner inverted toroidal whistle 72 and outer toroidal whistle 70 may be supplied from the same air source directed into bowl 84. Air supplied to bowl 84 escapes the bowl via radially oriented channels 88 from the bowl into an annular manifold 86. Annular manifold 86 is defined by a structure 98 and is substantially covered with an outer languid plate 99 which is sized to leave a perimeter annular slit 94 from which a cylindrical jet of air escapes.

What is claimed is:

1. An acoustic projector comprising:

a toroidal whistle having an annular mouth, a bowl and an annular orifice from the bowl for releasing an air jet into the annular mouth configured to generate an isophasic sound beam;

a source of pressurized air for connection to the bowl;

a source of laminar air flow into the annular orifice; and a radiating surface radially displaced from the annular mouth, the radiating surface having a concave profile configured to reflect said isophasic sound beam generated at the mouth in a coherent beam on a radiant axis.

2. The acoustic projector of claim 1, further comprising:

a blade opposite the outlet orifice defining first and second paths for the air jet;

a tuned resonance chamber located along the first path; and the air jet providing a vibratory virtual piston producing the acoustic energy at a frequency defined by the resonance of the tuned resonance chamber.

3. The acoustic projector of claim 2, further comprising:

a valve for selectively connecting the source of pressurized air to the bowl; and means for controlling the valve for modulating the pressure of the pressurized air.

4. The acoustic projector of claim 3, further comprising:

the means for controlling including a high speed solenoid to impose complex waveforms on generated sound.

5. The acoustic projector of claim 2, further comprising:

the concave section of the reflector being shaped to define a focal ring; and the toroidal whistle being positioned to locate the annular mouth on the focal ring.

6. The acoustic projector of claim 2, further comprising:

the toroidal whistle being inverted; and the radiating surface being a spike reflector.

7. The acoustic projector of claim 6, further comprising:

the concave section of the reflector being shaped to define a focal ring; and the annular isophasic sound source being located on the focal ring of the reflector.

8. The acoustic projector of claim 2, further comprising:

the radiating surface being a bowl like reflector.

9. An acoustic projector comprising:

an annular isophasic sound source for emitting sound expanding radially outwardly from the annular isophasic sound source in the plane of the annular isophasic sound source, a laminar air flow being directed to an annular orifice to emit the annular isophasic sound; and a reflector circumscribing the annular isophasic sound source in the plane, the reflector having a concave section shaped in a configuration to reflect isophasic sound in a coherent beam on a radiant axis perpendicular to the plane.

10. The acoustic projector of claim 9, further comprising:

an inverted annular isophasic source located circumscribed by the annular isophasic source a spike reflector defining a focal ring; and the inverted annular isophasic source having an annular mouth locating on the focal ring of the spike reflector.

11. The acoustic projector of claim 9, further comprising:

means for varying the frequency of isophasic sound from the isophasic sound source and the inverted isophasic sound source.

12. The acoustic projector of claim 11, further comprising:

means for imposing complex waveforms on generated sound.

* * * * *